United States Patent [19]

Suginaka et al.

[11] Patent Number: 4,976,678

[45] Date of Patent: Dec. 11, 1990

[54] CENTRIFUGAL SEPARATOR

[75] Inventors: Yutaka Suginaka; Shigeru Taniguchi, both of Odawara, Japan

[73] Assignee: Meiji Milk Products Co., Ltd., Tokyo, Japan

[21] Appl. No.: 359,080

[22] Filed: May 31, 1989

[30] Foreign Application Priority Data

Jun. 7, 1988 [JP] Japan ..... 63-138447

[51] Int. Cl.[5] ..... B04B 1/00; B04B 1/08; B04B 11/00

[52] U.S. Cl. ..... 494/68; 494/56; 494/74; 494/76; 494/79

[58] Field of Search ..... 494/56, 44, 60–63, 494/67–69, 70–73, 74, 76, 79, 80; 210/360.1, 374, 380.1

[56] References Cited

U.S. PATENT DOCUMENTS

| | | | |
|---|---|---|---|
| 2,104,683 | 1/1938 | Van Rosen et al. | 494/68 |
| 2,259,665 | 10/1941 | Serrell, Jr. | 494/68 |
| 2,417,747 | 3/1947 | Flowers | 494/68 |
| 2,668,008 | 2/1954 | Spross | 494/79 |
| 3,301,476 | 1/1967 | Hemfort, Jr. | 494/70 |
| 4,160,521 | 7/1979 | Lindgren | 494/56 |
| 4,695,270 | 9/1987 | Zettier | 494/73 |
| 4,701,158 | 10/1987 | Inge et al. | 494/80 |
| 4,729,759 | 3/1988 | Krook et al. | 494/56 |
| 4,784,635 | 11/1988 | Bruning et al. | 494/67 |
| 4,840,612 | 6/1989 | Pallmar | 494/70 |

FOREIGN PATENT DOCUMENTS

| | | | |
|---|---|---|---|
| 2185425 | 7/1987 | United Kingdom | 494/73 |
| 2189172 | 10/1987 | United Kingdom | 494/73 |

*Primary Examiner*—Timothy F. Simone
*Attorney, Agent, or Firm*—Howson and Howson

[57] ABSTRACT

A centrifugal separator which enables extraction of particles as concentrated liquid of a uniform concentration under a low pressure without damaging to the particles and is particularly suitable for extraction of weak cells such as animal cells. The centrifugal separator includes a plurality of particle collecting chambers (104: 104*a*) partially defined by an inner wall face (121) of a rotor (103) the diameter of which increases substantially continuously and suddenly comparing with the diameter of another adjacent portion for the inner wall face of the rotor. Particles centrifugally separated from liquid in a separating chamber (109) in the rotor are introduced into the particle collecting chambers in which they are accelerated suddenly to form soil suspension having an increased fluidity. The soil suspension is then introduced into horizontally extending deriving pipes (105: 105*a:* 105*b:* 105*c:* 105*d:* 105*e*) of a small sectional area and then extracted to the outside by way of an extracting pipe (118).

8 Claims, 7 Drawing Sheets

CENTRIFUGAL SEPARATOR

BACKGROUND OF THE INVENTION (1) Field of the Invention

This invention relates to a centrifugal separator suitable for collecting particles from liquid in which such particles are contained and for discharging the collected particles as concentrated liquid.

(2) Description of the Prior Art

Centrifugal separators are already known which include a mechanism which separates particles from liquid in which such particles are contained, collects the thus separated particles as concentrated liquid and automatically and continuously discharges the thus concentrated liquid therefrom to the outside. An exemplary one of such conventional centrifugal separators is shown in FIGS. 9*a* and 9*b*.

Referring to FIGS. 9*a* and 9*b*, the centrifugal separator shown is designed to separate and collect microorganisms and/or yeast from fermented liquid of such microorganisms and/or yeast and extract the microorganisms and/or yeast as concentrated liquid to the outside. The centrifugal separator thus has a collecting and extracting mechanism which includes a plurality of collecting chambers 4 provided in a circumferential direction of an inner peripheral wall of a rotor 3 composed of a drum cover 1 and a drum 2, a plurality of concentrated liquid deriving pipes 5 each having one end opened to a deepest portion of a collecting chamber 4 and extending downwardly in a contacting relationship with an inclined portion of the inner wall face of the drum 2 until the other end thereof is connected and opened to an outer peripheral side wall of a pairing chamber 31, and a plurality of pairing tube 32 extending obliquely downwardly from a base end portion of a stationary concentrated liquid extracting tube 6 and opened at the other ends thereof to the inside of the pairing chamber 31.

As apparently seen in FIG. 9*b*, each of the collecting chambers 4 is formed such that it has a substantially pyramid-shaped configuration with the inner peripheral wall of the drum 2 bent outwardly to provide inclined faces, and the deepest portion of each of the collecting chambers 4 is an outermost portion of the inner peripheral wall of the drum 2. A plurality of flow paths 33 are formed axially in and through a lower portion of the drum 2 from an outermost portion of the rotor 3.

With the centrifugal separator having such a construction as described above, centrifugally separated particles are moved along the inner peripheral wall of the rotor 3 and collected into the collecting chambers 4 and then introduced from the collecting chambers 4 into the concentrated liquid deriving pipes 5 and then into the pairing chamber 31. In the pairing chamber 31, the particles are turned together with the liquid and kinetic energy of them is converted into energy of pressure. By the energy of pressure, the concentrated liquid of the particles is flowed into the stationary pairing tube 32 and then forwarded to the outside by way of the concentrated liquid extracting tube 6. The flow paths 33 formed in the outermost portion of the rotor 3 have a function to intermediately wash the centrifugal separator during continuous running and are thus opened and closed by a hydraulic pressure or the like to permit particles accumulated in the collecting chambers 4 to be discharged to the outside to enable continuous running of the centrifugal separator for a long period of time.

In such a conventional centrifugal separator as described above, deposits of densely accumulated particles can be seen in the collecting chambers 4 during running of the centrifugal separator, but no deposit can be seen near exits of the concentrated liquid deriving pipes 5. In this instance, the particle concentration of concentrated liquid extracted from the concentrated liquid extracting pipe 6 exhibits a tendency that it decreases gradually as the running time passes. The phenomenon makes it impossible to successively extract particles smoothly and causes dispersion and/or elongation of the residence time of particles in a field of centrifugal force. Where such particles are weak like animal cells, there is the possibility that the survival rate of the particles may be deteriorated. Further, while concentrated liquid of such particles must be successively extracted under a low pressure by an enclosed system, it is considered that extraction under a pressure by the pairing chamber 31 is not preferable.

SUMMARY OF THE INVENTION

It is an object of the present invention to provide a centrifugal separator which enables extraction of particles as concentrated liquid of a uniform concentration by increasing the fluidity of particles in the collecting chamber (4) to minimize the period of time during which the particles stay in the rotor (3).

It is another object of the present invention to provide a centrifugal separator which enables external extraction of particles under a low pressure without damaging to the particles.

In order to attain the objects, according to the present invention, there is provided a centrifugal separator which includes a rotor composed of a drum and a drum cover, a plurality of particle collecting chambers defined by a plurality of members which extend radially inwardly from a maximum diameter portion of an inner wall face of the rotor toward an axis of the rotor, and means for continuously extracting particles as concentrate from said collecting chambers by moving the concentrate toward said axis, in which each of said collecting chambers is an annular, circumferentially extending space; in which the boundary of said collecting chambers is defined at least in part by said inner wall face of said rotor; in which said inner wall face has a sharp transition at an axial location adjacent to the axial location of said maximum diameter portion; in which the diameter of the inner wall face increases continuously and gradually toward the axial location of said transition from the location of a smaller diameter portion of said inner wall face spaced axially from said transition; and in which the diameter of said inner wall face increases rapidly from said transition to said maximum diameter portion.

With the centrifugal separator, particles are accelerated in the collecting chambers so that they are readily suspended and their fluidity is increased. Further, since the concentrated liquid deriving pipes extend horizontally and have a small sectional area, the discharging flow rate of particles sufficient to surmount the centrifugal force necessary for prevention of such re-separation of particle concentrated liquid in the concentrated liquid deriving pipes that may take place when the particle concentrated liquid is to be extracted from the field of centrifugal force can be minimized. Consequently, it is possible to enable discharging of particle concentrated liquid without increasing the internal pressure of the collecting chambers comparing with concentrated liquid deriving pipes of the conventional type.

Consequently, concentrated liquid of particles having a uniform concentration can be extracted smoothly with very small centrifugal force up to several 10 G or so without accumulating particles within the separator. Accordingly, the centrifugal separator of the present invention is particularly suitable to separate and collect weak cells which are low in resistance to consolidation and shearing force such as animal cells from culture solution of the cells and to extract the collected cells as concentrated liquid without deteriorating the survival rate and without accumulating cells in the collecting chambers.

A specific embodiment of the present invention will now be described in detail by way of example with reference to the accompanying drawings.

DETAILED DESCRIPTION OF THE ILLUSTRATED EMBODIMENTS

Figure 1:
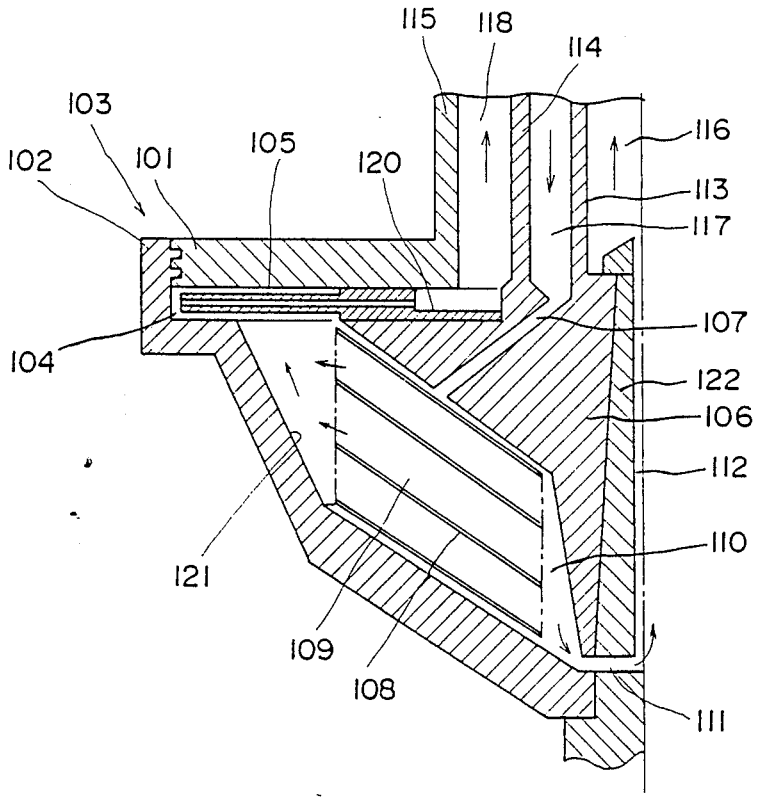
FIG. 1 is a partial vertical sectional view of a centrifugal separator showing a first embodiment of the present invention.

At first, description will be given of construction of a centrifugal separator according to the present invention which is common to all of the embodiments shown in FIGS. 1 to 8.

Referring to FIGS. 1 to 8, a centrifugal separator according to the present invention includes a rotor 103 which includes a drum 102 and a drum cover 101 connected to each other in an axial direction. The entire rotor 103 is supported for integral rotation on a drive shaft 122.

A plurality of separating discs 108 are disposed in the inside of the rotor 103 and supported in an overlapping relationship on a distributor 106, and a separating chamber 109 is formed in the rotor 103.

A liquid supply pipe 117 for supplying therethrough liquid which contains particles therein, a concentrated liquid extracting pipe 118 for separated particles and a clarified liquid extracting pipe 116 are provided in a concentrical relationship at central portions of the top of the rotor 103. The pipes 117, 118 and 116 are rotated by and together with the rotor 103 and are connected to external corresponding stationary pipes not shown in a shaft sealing relationship by known means such as rubber seals or mechanical seals. It is to be noted that either a control valve or an extracting pump may be provided for the stationary pipe which is connected to the concentrated liquid extracting pipe 118.

Subsequently, detailed description will be given of a construction of collecting chambers 104 for particle concentrated liquid and a concentrated liquid deriving pipe 105 for communicating the collecting chambers and a concentrated liquid extracting pipe 118 with each other, which constitute essential part of the present invention.

The rotor 103 has an inner wall face 121 partially defining an annular spacing which extends in a circumferential direction of the inner wall face 121 and is partitioned by a plurality of partitioning members 119 to thus form a plurality of collecting chambers 104. The portion of the inner wall face 121 of the rotor 103 which defines the annular spacing is formed such that the inner diameter thereof increases substantially continuously and suddenly comparing with the inner diameter of another adjacent portion of the inner wall face 121 of the rotor 103 and a maximum inner diameter is given by the deepest inner wall face 121 for the annular spacing. The partitioning members 119 are disposed in a juxtaposed relationship such that the circumferential width thereof may decrease radially inwardly of the rotor 103 from portions thereof adjacent the deepest inner wall face 121 of the rotor 103 for the annular spacing and their inner ends may terminate at or near an entrance of the annular spacing.

Each of the collecting chambers 104 formed in such a manner as described above has a vertical sectional area (as taken in parallel to the axis of the rotor 103) which is greatest at an entrance at an inner end of the collecting chamber 104 and decreases radially outwardly from the entrance. An open end of a concentrated liquid deriving pipe 105 which will be hereinafter described is located near a deepest or radially outermost portion of each of the collecting chambers 104.

Depending upon characteristics of particles, a portion 121*a* of the inner wall face 121 of the rotor 103 adjacent the entrance of the annular spacing may be inclined at a gentler slope with respect to the axis of the rotor 103 so that it may serve as a particle accelerating section.

Each of the concentrated liquid deriving pipes 105 for deriving concentrated liquid of particles from the collecting chambers 104 is opened at an outer end thereof near the deepest portion of the collecting chamber 104 and extends directly from the location in a horizontal direction or at very gentle slope toward a base end portion of the concentrated liquid extracting pipe 118 located at the central portion of the top of the rotor 103. The inner end of each of the concentrated liquid deriving pipes 105 is thus opened to the base end of the concentrated liquid extracting pipe 118.

Preferably, the openings of the concentrated liquid deriving pipes 105 in the collecting chambers 104 and the openings of the concentrated liquid deriving pipes 105 to the concentrated liquid extracting pipe 118 are formed in a same horizontal plane. In this regard, however, according to the present invention, only it is essential to communicate the deepest portions of the collecting chambers 104 and the base end portion of the concentrated liquid extracting pipe 118 directly and substantially horizontally with each other.

With the centrifugal separator having such a construction as described above, liquid which contains particles therein is supplied from the liquid supply pipe 117 and flowed through distributing paths 107 formed in the distributor 106 into passing holes (not shown) formed corresponding to the distributing paths 107 in the separating discs 108. Then, the liquid between the separating discs 108 is acted upon by centrifugal force so that particles which have a comparatively high specific gravity are moved radially outwardly along the separating discs 108 to the inner wall face 121 of the drum 102. To the contrary, clarified liquid which has a comparatively low specific gravity is moved radially inwardly of the rotor 103 and thus taken out by way of the clarified liquid extracting pipe 116.

The particles moved to the inner wall face 121 of the drum 102 are moved along the inner wall face 121 toward the collecting chambers 104. The particles are thus flowed into the collecting chambers 104 and then accelerated suddenly in the collecting chambers 104 because the portion of the inner wall face 121 of the rotor 103 which defines the annular spacing is formed such that the inner diameter thereof increases substantially continuously and suddenly comparing with the inner diameter of the adjacent lower portion of the inner wall face 121 of the rotor 103 as described hereinabove. Consequently, the particles are dispersed readily and at the same time accompanied by liquid so that they are readily suspended and increase in fluidity. The concentrated liquid of the thus fluidized particles then come to the deepest portions of the collecting chambers 104 and are then introduced into the concentrated liquid deriving pipes 105, **105*a*, 105*b*, 105*c*, 105*d* or 105*e*, from which they are directly extracted to the outside by way of the concentrated liquid extracting pipe 118. Since the concentrated liquid deriving pipes 105, 105*a*, 105*b*, 105*c*, 105*d* or 105*e* have a small sectional area and extend in horizontal directions, the particle discharging flow speed which prevails over centrifugal force required for prevention of re-separation in the concentrated liquid deriving pipes 105, 105*a*, 105*b*, 105*c*, 105*d* or 105*e*** which takes place when concentrated liquid of particles is to be taken out from a field of centrifugal force can be minimized. Consequently, discharge of concentrated liquid of particles is enabled without increasing the internal pressure comparing with inclined concentrated liquid deriving pipes of a conventional centrifugal separator.

Figure 2:
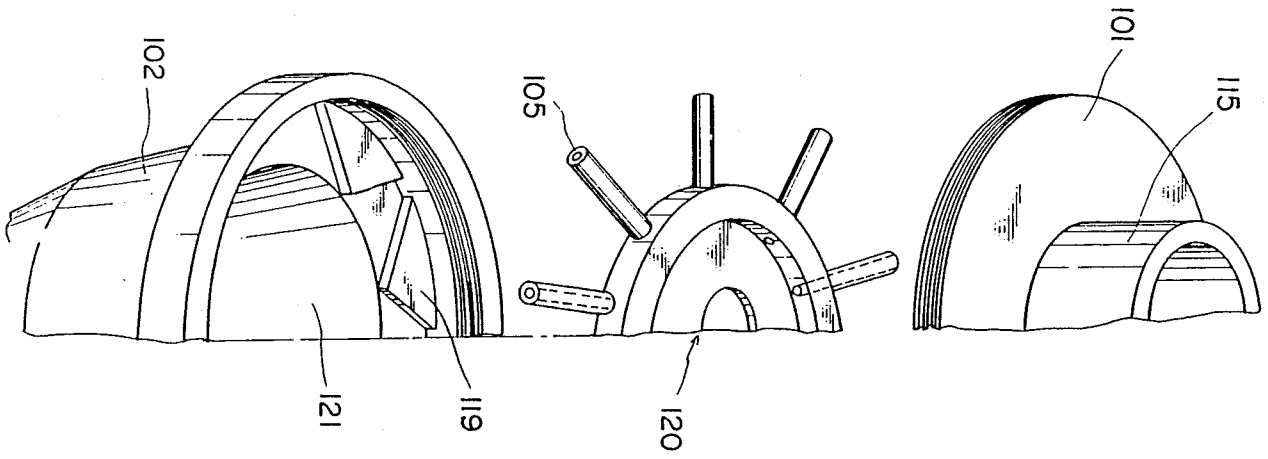
FIG. 2 is a fragmentary perspective view of part of the centrifugal separator shown in FIG. 1.

In the following, the centrifugal separators of the several embodiments of the present invention will be described individually in detail. Referring first to FIGS. 1 and 2, there is shown a centrifugal separator according to a first preferred embodiment of the present invention. The centrifugal separator shown includes a rotor 103 secured for integral rotation to a drive shaft 122. The rotor 103 includes a drum 102 having such a configuration as hereinafter described, and a drum cover 101 screwed in an enclosing relationship to the drum 102. A distributor 106 having a substantially inverted conical profile is disposed in the inside of the rotor 103. A separating chamber 109 is thus defined by the drum cover 101, drum 102 and distributor 106.

A plurality of inverted conical separating discs 108 are disposed in the separating chamber 109 and supported in an overlapping relationship on the distributor 106. Each of the inverted conical separating discs 108 has a plurality of liquid passing holes perforated therein. A clarified liquid guide path 110 is defined between the distributor 106 and inner ends of the separating discs 108.

A path 112 is formed in an axial direction in the drive shaft 122. A lowermost portion of the path 112 communicates with a lowermost portion of the clarified liquid guide path 110 by way of a plurality of communicating holes 111 formed radially in the drive shaft 122. Meanwhile, an uppermost portion of the path 112 is opened to a clarified liquid extracting pipe 116 which will be hereinafter described.

The distributor 106 has an inner wall 113 and an intermediate wall 114 in the form of pipes formed uprightly in a concentrical relationship around the axis of the rotor 103 at the top thereof. A clarified liquid extracting pipe 116 is thus defined by the inner wall 113 while a liquid supply pipe 117 for supplying therethrough liquid which contains particles therein is defined by the inner wall 113 and the intermediate wall 114. An outer wall 115 in the form of a pipe is formed uprightly on the drum cover 101 around a center hole formed in the drum cover 101 and cooperates with the intermediate wall 114 of the distributor 106 to define therebetween a concentrated liquid extracting pipe 118 for extracting concentrated liquid of separated. particles therethrough. The distributor 106 has a plurality of distributing paths 107 perforated therein for establishing communication between the liquid supply pipe 117 and the liquid passing holes perforated in the separating discs 108.

As particularly seen in FIG. 1, the drum 102 has an inner wall face 121 which first extends conically upwardly in a comparatively gentle slope from an inner end thereof adjacent the outer ends of the communicating holes 111 in the drive shaft 122 and then extends conically upwardly in a comparatively steep slope and then horizontally outwards in a concentrical relationship around the axis of the rotor 103. The inner wall face 121 of the drum 102 further extends vertically upwardly from an outer end of the horizontal annular portion thereof, and the rotor 103 presents its maximum diameter at a wall thereof on which the inner wall face 121 extends vertically upwardly.

Referring to FIG. 2, a plurality of substantially sectoral partitioning members 119 having a predetermined thickness are mounted in a circumferential row on the horizontal annular portion of the inner wall face 121 of the drum 102. The partitioning members 119 are disposed such that the vertexes thereof are directed toward the axis of the rotor 103 while the arcuate bottom sides thereof are held in contact with the vertical portion of the inner wall face 121 of the drum 102, and the opposite ends of the arcuate bottom side of each of the partitioning members 119 are spaced by a predetermined small distance from opposing ones of the opposite ends of the arcuate bottom sides of adjacent partitioning members 119.

As described hereinabove, the drum cover 101 is screwed to and covers the drum 102, thereby forming the rotor 103. In this condition, the top faces of the partitioning members 119 contact with the bottom face of the drum cover 102. A plurality of collecting chambers 104 are thus defined by the drum 102, drum cover 101 and partitioning members 119. Each of the collecting chambers 104 has such a configuration that the width or circumferential dimension thereof is greatest at an inner end thereof in a radial direction of the rotor 103 and gradually decreases toward an outer end thereof.

Referring to FIGS. 1 and 2, the concentrated liquid deriving pipes 105 are mounted on a path defining member 120. The path defining member 120 is composed of a disk-like member having a center hole formed therein for fitting with a base end portion of the intermediate wall 114 of the distributor 106, and a ring-like member of a rectangular cross section having a thickness substantially equal to the dimension of a vertical section of the entrance of a collecting chamber 104 and connected in an integral contiguous relationship to an outer circumferential side of the disk-like member. The ring-like member of the path defining member 120 has a plurality of through-holes formed horizontally radially inwards from an outer circumferential wall thereof and communicated with the base end portion of the concentrated liquid extracting pipe 118. The concentrated liquid deriving pipes 105 have a same inner diameter as the inner diameter of the through-holes of the path defining member 120 and are mounted on the path defining member 120 such that they may communicate horizontally with the through-holes of the path defining member 120. The path defining member 120 on which the concentrated liquid deriving pipes 105 are mounted is first fitted with the base end portion of the intermediate wall 114 and then securely held between the drum cover 101 and the distributor 106. In this instance, the outer ends of the concentrated liquid deriving pipes 105 are opened near the deepest portions of the collecting chambers 104, and the outer openings of the concentrated liquid deriving pipes 105 and the inner ends of the through-holes in the path defining member 120 are located in a same horizontal plane.

In operation, the rotor 103 and the distributor 106 located in the inside of the rotor 103 are rotated in an integral relationship by the drive shaft 122. Liquid in which particles to be separated are contained is supplied by way of the liquid supply pipe 117. The liquid passes through the distributing paths 107 and flows into the passing holes of the individual separating discs 108 disposed in an overlapping relationship in the separating chamber 109 and are thus introduced into spacings between the individual separating discs 108. Here, particles in the liquid are moved toward the inner wall face 121 of the drum 102 along the individual separating discs 108 due to an action of centrifugal force. On the other hand, clarified liquid which has a comparatively low specific gravity is flowed radially inwardly and then vertically downwardly in the axial direction of the drum 102 along the clarified liquid guide path 110, and then the clarified liquid is introduced into the communicating holes 111 and then into the path 112 in the drive shaft 122 whereafter it is discharged to the outside by way of the clarified liquid extracting pipe 116.

The particles moved to the inner wall face 121 of the drum 102 are then successively moved upwardly along the inclined portion of the inner wall face 121 and thus introduced into the collecting chambers 104 in which they are suddenly accelerated. Thereupon, the particles are put into a suspended condition very readily together with liquid accompanying therewith. Consequently, no particles are accumulated nor densely deposited in or near the collecting chambers 104, and accordingly it is possible to collect concentrated liquid which always contain particles in a uniform density. The concentrated liquid is introduced from the deepest portions of the collecting chambers 104 into the concentrated liquid deriving pipes 105 and then sent directly to the base end of the concentrated liquid extracting pipe 118 by way of which it is subsequently discharged to the outside. The concentrated liquid deriving pipes 105 which extend horizontally require decreased energy of pressure for discharging comparing with conventional inclined concentrated liquid deriving pipes and thus facilitates external discharge of concentrated material together with such ready suspension as described above.

Figure 3:
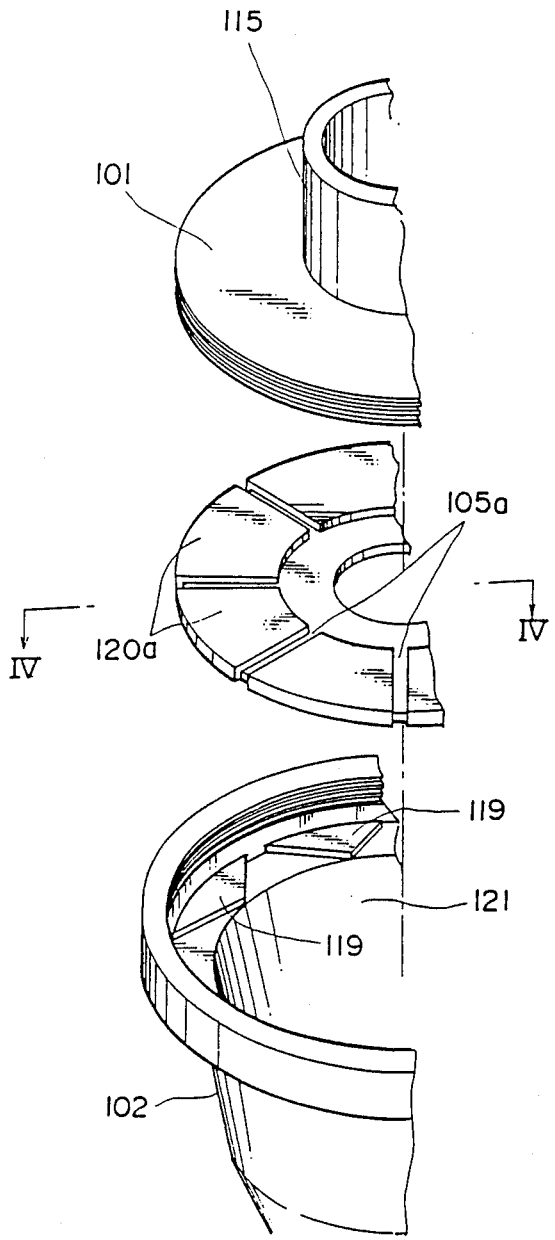
FIG. 3 is a similar view but showing a second embodiment of the present invention.
Figure 4:
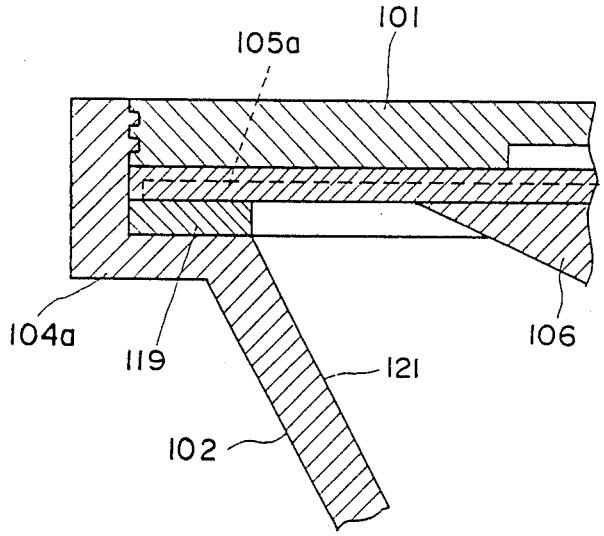
FIG. 4 is a partial sectional view taken along line IV—IV of FIG. 3.

Referring now to FIGS. 3 and 4, there is shown a centrifugal separator according to a second preferred embodiment of the present invention. In the centrifugal separator shown, a plurality of partitioning members 119 are disposed on an inner wall face 121 of a drum 102 in a similar manner as in the first embodiment described hereinabove. A path defining member **120*a* is adhered to and supported between upper faces of the partitioning members 119 and a distributor 106 and a lower face of a drum cover 101. In this instance, an outer circumferential wall of the path defining member 120*a* is held in contact with a maximum diameter portion of the inner wall face 121 of the drum 102, and a plurality of concentrated liquid deriving grooves 105*a* are formed radially in an upper wall of and the outer circumferential wall of the path defining member 120*a* for establishing communication between deepest portions of collecting chambers 104*a* and a base end of a concentrated liquid extracting pipe 118. The grooves 105*a* are closed by the inner wall face of the drum 102 and the drum cover 101** to thus form concentrated liquid deriving pipes.

Figure 5:
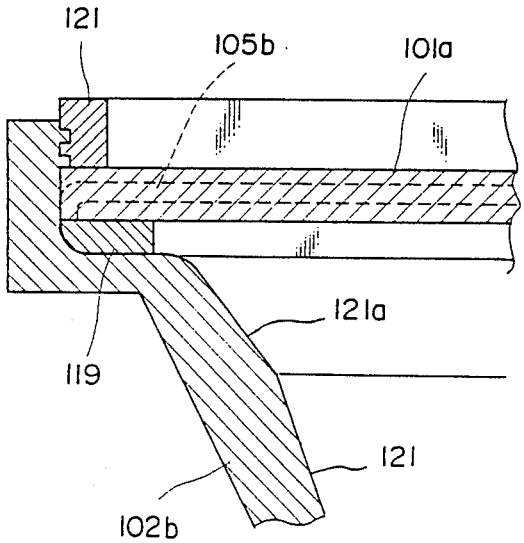
FIG. 5 is a similar view but showing a modification to the centrifugal separator shown in FIG. 4.
Figure 6A:
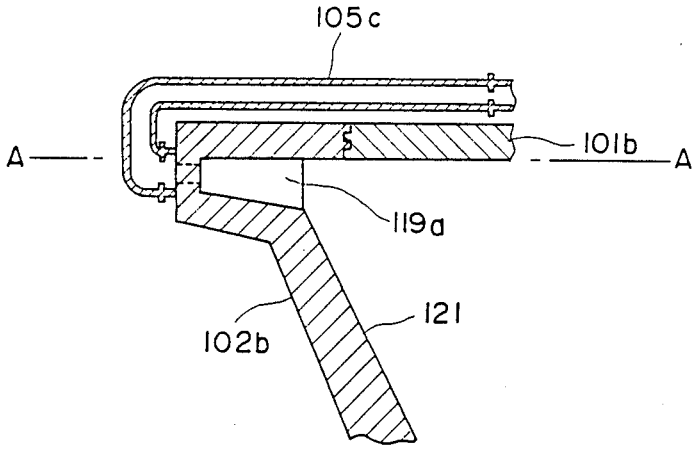
FIG. 6*a* is a partial vertical sectional view of a centrifugal separator showing a third embodiment of the present invention.
Figure 6B:
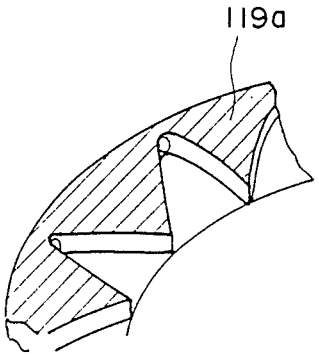
FIG. 6*b* is a perspective sectional view taken along line A—A of FIG. 6*a;*

FIG. 5 illustrates a modification to the concentrated liquid deriving pipes in the embodiment shown in FIGS. 3 and 4. Referring to FIG. 5, a drum cover **101*a* contacts at an outer circumferential wall thereof with a maximum diameter portion of an inner wall face 121 of a drum 102*b* and has a plurality of grooves formed in the outer circumferential wall thereof in a communicating relationship with deepest portions of collecting chambers. The grooves are communicated with a concentrated liquid extracting pipe by way of a plurality of concentrating liquid deriving holes 105*b* formed radially in the drum cover 101*a*. In this instance, a plurality of collecting chambers are defined by the drum cover 101*a*, a horizontal annular portion of the inner wall face 121 of the drum 102*b* and a plurality of partitioning members 119. Another portion 121*a* of the inner wall face 121 of the drum 102*b* adjacent the horizontal annular portion is inclined more gently than a further portion of the inner wall face 121 below the portion 121*a*. The gently inclined portin 121*a* acts as a particle accelerating section for accelerating therealong particles guided thereto by the further portion therebelow. Meanwhile, the partitioning members 119** are formed such that the radially inner ends thereof terminate at locations radially outwardly of entrances of the collecting chambers. Further, lower portions of the deepest portions of the collecting chambers are generally rounded so as to eliminate dead spaces.

Referring now to FIGS. **6*a* and 6*b*, there is shown a centrifugal separator according to a third preferred embodiment of the present invention. In the centrifugal separator shown, an inclined upper portion of an inner wall face 121 of a drum 102*b* is formed in a very gently sloped face, and the inner wall face 121 extends vertically upwardly from an outer end of the inclined upper portion thereof and then horizontally radially inwards from an upper end of the vertical portion thereof. An annular spacing extending in a circumferential direction in a rotor 103 is thus defined by the inclined upper portion, vertical portion and horizontal portion of the inner wall face 121 of the drum 102***b*. A single partitioning member 119*a* is disposed in the annular spacing to form a plurality of collecting chambers, and a plurality of holes are formed in the partitioning member 119*a* and extend horizontally radially outwards from deepest portions of the collecting chambers to an outer circumferential face of the drum 102*b*. A plurality of concentrated liquid deriving pipes 105*c* are connected to the radial holes formed in the partitioning member 119*a*. The concentrated liquid deriving pipes 105*c* extend first horizontally radially outwards, then vertically upwardly and then horizontally radially inwards above a drum cover 101*b* toward an outer wall (not shown) formed on the drum cover 101*b*. The concentrated liquid deriving pipes 105*c* are thus connected at the other ends thereof to through-holes (not shown) perforated in the outer wall.

Figure 7:
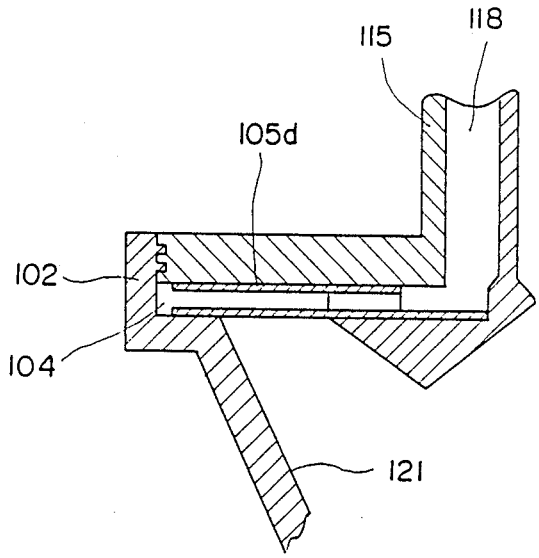
FIG. 7 is a partial vertical sectional view of a centrifugal separator showing a fourth embodiment of the present invention.

Referring to FIG. 7, there is shown a centrifugal separator according to a fourth preferred embodiment of the present invention. The centrifugal separator has a substantially similar construction to the centrifugal separator of the first embodiment shown in FIG. 1 except that it includes a plurality of modified concentrated liquid deriving pipes 105*d*. In particular, the modified concentrated liquid deriving pipes 105*d* have a same outer diameter over the entire lengths thereof and contact at the top and bottom portions of the outer circumferential faces thereof respectively with a lower face of a drum cover 101 and a horizontal portion of an inner wall face 121 of a drum 102 which define a plurality of collecting chambers 104 therebetween. In the centrifugal separator of the present embodiment, concentrated liquid of particles flow into each of the collecting chambers 104 through a pair of gaps formed between a concentrated liquid deriving pipe 105*d* and opposing side faces of a pair of partitioning members 119 located on the opposite sides of the concentrated liquid deriving pipe 105*d*.

Figure 8:
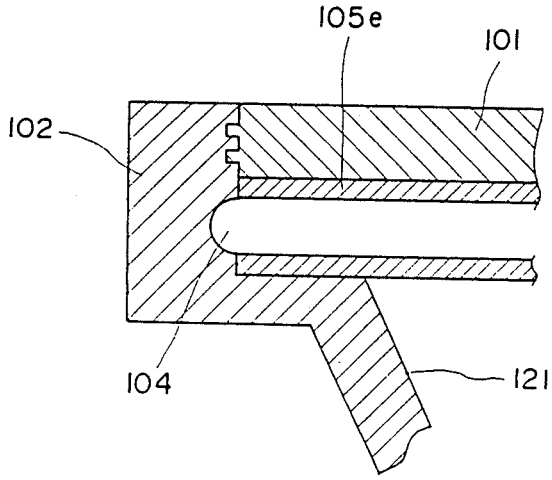
FIG. 8 is a similar view but showing a modification to the centrifugal separator shown in FIG. 7.
Figure 9A:
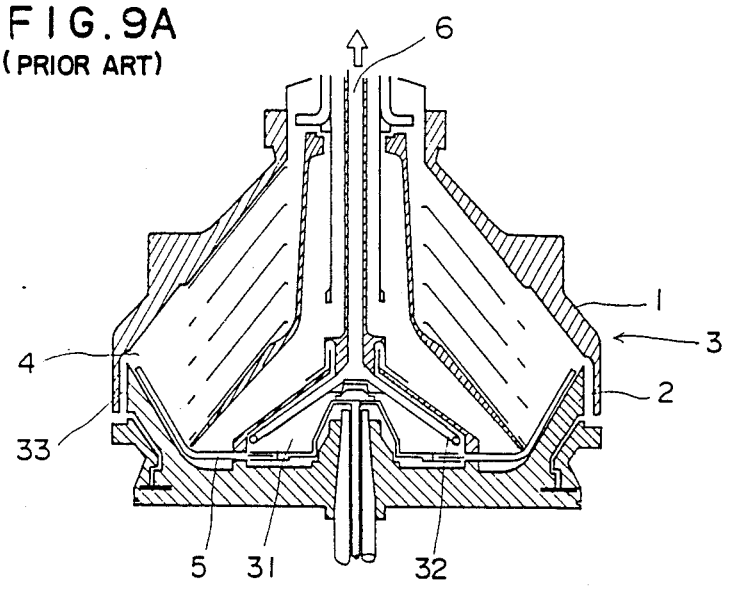
FIG. 9A (PRIOR ART)
FIG. 9*a* is a vertical sectional view of an exemplary conventional centrifugal separator.
Figure 9B:
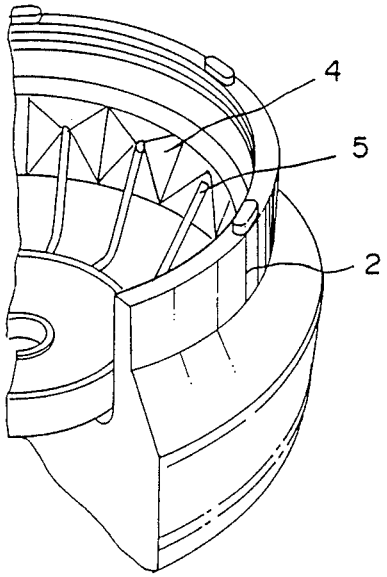
FIG. 9B (PRIOR ART)
FIG. 9*b* is a partial perspective view of the centrifugal separator shown in FIG. 9*a*.

FIG. 8 illustrates a modification to the centrifugal separator of the fourth embodiment shown in FIG. 7. Referring to FIG. 8, the centrifugal separator shown includes a plurality of modified concentrated liquid deriving pipes 105*e* to the concentrated liquid deriving pipes 105*d* of the centrifugal separator shown in FIG. 7. In particular, the concentrated liquid deriving pipes 105*e* extend radially outwardly until outer ends thereof contact with an inner wall face 121 of a drum 102 which defines a plurality of collecting chambers 104. Meanwhile, a plurality of grooves or recesses having a semi-circular cross section corresponding to openings of the concentrated liquid deriving pipes 105*d* are formed in a vertical maximum diameter portion of the inner wall face 121 of the drum 102. Also in the present centrifugal separator, concentrated liquid of particles flow into each of the semi-circular recesses of the collecting chambers 104 through a pair of gaps formed between a concentrated liquid deriving pipe 105*e* and opposing side faces of a pair of partitioning members 119 located on the opposite sides of the concentrated liquid deriving pipe 105*d*.

Having now fully described the invention, it will be apparent to one of ordinary skill in the art that many changes and modifications can be made thereto without departing from the spirit and scope of the invention as set forth herein.

We claim:

1. A centrifugal separator which includes a rotor (103) composed of a drum, a drum cover, an inner wall face (121), a plurality of particle collecting chambers defined by a plurality of members which extend radially inwardly from a maximum diameter portion of said inner wall face of said rotor toward an axis of said rotor, and means for continuously extracting particles as concentrate from said collecting chambers by moving the concentrate toward said axis, in which each of said collecting chambers (104:104*a*) is an annular, circumferentially extending space; in which the boundary of said collecting chambers is defined at least in part by said inner wall face of said rotor; in which said inner wall face has a sharp transition at an axial location adjacent to the axial location of said maximum diameter portion; in which the diameter of the inner wall face increases continuously and gradually toward the axial location of said transition from the location of a smaller diameter portion of said inner wall face spaced axially from said transition; and in which the diameter of said inner wall face increases rapidly from said transition to said maximum diameter portion.

2. A centrifugal separator as set forth in claim 1, in which said collecting chambers (104; 104*a*) are formed by partitioning said annular space into a plurality of sections by means of a plurality of partitioning members (119; 119*a*); said partitioning members extend radially inwardly from said maximum diameter portion of said inner wall face of said rotor toward the axis of said rotor; the circumferential width thereof decreases toward the axis of said rotor; and the inner ends of said partitioning members terminate substantially at an entrance of said annular space.

3. A centrifugal separator as set forth in claim 1, in which said means for extracting particles as concentrate from said collecting chambers (104; 104*a*) includes a concentrated liquid extracting pipe (118) having a base end portion, and a plurality of concentrated liquid deriving pipes (105; 105*a*, 105*b*; 105*c*; 105*d*; 105*e*) which are opened at ends thereof near deepest portions of said collecting chambers, extend radially inwardly in substantially horizontal directions directly from the locations of said ends toward said base end portion of said concentrated liquid extracting pipe, and are connected and opened at the other ends thereof to the base end portion of said concentrated liquid extracting pipe.

4. A centrifugal separator as set forth in claim 2, in which said means for extracting particles as concentrate from said collecting chambers (104; 104*a*) includes a concentrated liquid extracting pipe (118) having a base end portion, and a plurality of concentrated liquid deriving pipes (105; 105*a*; 105*b*; 105*c*; 105*d*; 105*e*) which are opened at ends thereof near deepest portions of said collecting chambers, extend radially inwardly in substantially horizontal directions directly from the locations of said ends toward said base end portion of said concentrated liquid extracting pipe, and are connected and opened at the other ends thereof to the base end portion of said concentrated liquid extracting pipe.

5. A centrifugal separator as set forth in claim 1, in which a first portion (121*a*) of said inner wall face (121) of said rotor (103) just below the axial location of said collecting chambers (104; 104*a*) is inclined radially outwardly at a slope which is more nearly radial than the slope of (another) an adjacent portion of said inner wall face below said first portion, in order to accelerate particles at said first portion.

6. A centrifugal separator as set forth in claim 2, in which a first portion (121*a*) of said inner wall face (121) of said rotor (103) just below the axial location of said collecting chambers (104; 104*a*) is inclined radially outwardly at a slope which is more nearly radial than the slope of (another) an adjacent portion of said inner wall face below said first portion, in order to accelerate particles at said first portion.

7. A centrifugal separator as set forth in claim 3, in which a first portion (121*a*) of said inner wall face (121) of said rotor (103) just below the axial location of said collecting chambers (104; 104*a*) is inclined radially outwardly at a slope which is more nearly radial than the slope of (another) an adjacent portion of said inner wall face below said first portion, in order to accelerate particles at said first portion.

8. A centrifugal separator as set forth in claim 4 in which a first portion (121*a*) of said inner wall face (121) of said rotor (103) just below the axial location of said collecting chambers (104; 104*a*) is inclined radially outwardly at a slope which is more nearly radial than the slope of (another) an adjacent portion of said inner wall face below said first portion, in order to accelerate particles at said first portion.

* * * * *